US010466639B2

(12) United States Patent
Kanno

(10) Patent No.: US 10,466,639 B2
(45) Date of Patent: Nov. 5, 2019

(54) IMAGE FORMING APPARATUS CAPABLE OF PERFORMING JAM PROCESSING

(71) Applicant: CANON KABUSHIKI KAISHA, Tokyo (JP)

(72) Inventor: Takashi Kanno, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/625,325

(22) Filed: Jun. 16, 2017

(65) Prior Publication Data

US 2018/0004148 A1 Jan. 4, 2018

(30) Foreign Application Priority Data

Jun. 29, 2016 (JP) ..... 2016-129079

(51) Int. Cl.
*G03G 15/00* (2006.01)

(52) U.S. Cl.
CPC ..... *G03G 15/70* (2013.01)

(58) Field of Classification Search
CPC ..... G03G 15/70; G03G 21/1623; G03G 15/6502; G03G 21/1638; G03G 21/1695; G03G 2215/00434; G03G 2215/00544; G03G 2215/00713
See application file for complete search history.

(56) References Cited

U.S. PATENT DOCUMENTS 9,176,462 B2 11/2015 Ohta et al.
2009/0257760 A1* 10/2009 Kaneda ..... G03G 15/5012 399/18
2014/0167580 A1* 6/2014 Funayama ..... E05B 47/0012 312/237
2014/0169828 A1* 6/2014 Ohta ..... G03G 15/6502 399/110
2016/0026142 A1* 1/2016 Asano ..... G03G 15/5004 399/21
2016/0221770 A1* 8/2016 Ishii ..... B65H 1/266

FOREIGN PATENT DOCUMENTS

JP 4500368 B1 7/2010

* cited by examiner

*Primary Examiner* — David H Banh
(74) *Attorney, Agent, or Firm* — Rossi, Kimms & McDowell LLP

(57) ABSTRACT

An image forming apparatus capable of preventing a job from being forcibly terminated when it is unnecessary to remove a removable unit, and thereby reducing downtime. The image forming apparatus is provided with a drawer unit as a movable unit, which can be drawn out from the apparatus, and a lock unit that can be switched between a locking state in which the drawer unit is inhibited from being drawn out and an unlocking state in which the drawer unit is allowed to be drawn out. When a jam occurs at a position outside a predetermined range in which it is necessary to draw out the drawer unit to perform jam processing, the job interrupted due to the jam is resumed after completion of jam processing without forcibly terminating the job even when the unlocking state of the lock unit is not detected.

11 Claims, 10 Drawing Sheets

*FIG. 5*

LOCK CONDITION TABLE

| S1 | S2 | S3 | S4 | S5 | S6 | S7 | S8 | S9 | S10 | PROCESSING |
|---|---|---|---|---|---|---|---|---|---|---|
| - | - | - | SHEET DETECTED | SHEET DETECTED | - | - | - | - | - | LOCK |
| - | - | - | - | - | - | - | SHEET DETECTED | SHEET DETECTED | - | LOCK |

- : SHEET DETECTED OR SHEET NOT DETECTED

IMAGE FORMING APPARATUS CAPABLE OF PERFORMING JAM PROCESSING

BACKGROUND OF THE INVENTION

Field of the Invention

The present invention relates to an image forming apparatus that performs image formation on a sheet which is conveyed.

Description of the Related Art

Conventionally, in an image forming apparatus that performs image formation on a sheet which is conveyed, a so-called jam sometimes occurs in which a sheet remains in a conveying passage within the apparatus due to multiple feeding of sheets, a sheet conveyance failure, etc. For this reason, in general, to remove a sheet remaining in the conveying passage due to a jam, the image forming apparatus is configured to be capable of performing jam processing for removing the sheet from within the image forming apparatus.

An image forming apparatus disclosed in U.S. Pat. No. 9,176,462 is provided with a mechanism for locking a drawer unit configured to be capable of being drawn out from the image forming apparatus, to the image forming apparatus. Further, the image forming apparatus disclosed in U.S. Pat. No. 9,176,462 detects whether or not a remaining sheet extends in a manner crossing a boundary between a conveying passage of the image forming apparatus and a conveying passage within the drawer unit, and if it is detected that the remaining sheet extends in a manner crossing the boundary between the conveying passages, the drawer unit is locked so as to prevent the drawer unit from being drawn out from the image forming apparatus. Then, after jam processing is completed, the drawer unit is unlocked. Further, Japanese Patent No. 4500368 discloses a controller that controls the operation of an apparatus including a lid that opens and closes an opening formed in the image forming apparatus, and a lid locking device that, when the apparatus performs a predetermined operation, locks the lid such that the lid can neither be opened nor closed. The controller disclosed in Japanese Patent No. 4500368 judges that a lid lock error has occurred when the lid cannot be unlocked.

However, in the image forming apparatus disclosed in U.S. Pat. No. 9,176,462, in a case where despite controlling the lock mechanism to unlock the drawer unit, the drawer unit is not unlocked e.g. due to a failure of the lock mechanism, if it is judged that an error has occurred as in the case of Japanese Patent No. 4500368, a job being processed is terminated before finished. This causes, even when it is unnecessary to draw out the drawer unit, a job to be terminated before finished for the reason of a failure of the locking portion, making it impossible to resume the job.

More specifically, in a case where a jam occurs at a point upstream or downstream of the drawer unit, it is unnecessary to draw out the drawer unit to perform jam processing. In this case, even if the locking mechanism is faulty, when jam processing is completed, image formation itself can be resumed. However, if this situation is uniformly treated as an error to terminate the job before finished, unnecessary downtime is caused, which impairs user's convenience.

SUMMARY OF THE INVENTION

The present invention provides an image forming apparatus that is capable of preventing a job from being terminated before finished in a state in which it is unnecessary to remove a drawer unit, and thereby reducing downtime.

The present invention provides a image forming apparatus comprising a conveying unit configured to convey a sheet along a conveying path so as to process a job, a drawer unit that can be drawn out from an apparatus body, a lock portion that can be switched between a locking state for inhibiting the drawer unit from being drawn out and an unlocking state for allowing the drawer unit to be drawn out, a jam detector that detects a position in the conveying path where a jam of the sheet has occurred, a lock detector configured to detect a state of the lock portion, and a controller configured to resume, in a case where the jam detector has detected occurrence of a jam at a position outside a predetermined range in which it is unnecessary to draw out the drawer unit in order to perform jam processing, the job which has been interrupted due to the jam after completion of the jam processing, without terminating the job before finished, even when the lock detector has not detected the unlocking state of the lock portion.

According to the present invention, it is possible to prevent a job from being terminated before finished in a state in which it is unnecessary to remove the drawer unit, and thereby reduce downtime.

Further features of the present invention will become apparent from the following description of exemplary embodiments (with reference to the attached drawings).

BRIEF DESCRIPTION OF THE DRAWINGS

FIG. 5 is a diagram showing a lock condition table.

DESCRIPTION OF THE EMBODIMENTS

The present invention will now be described in detail below with reference to the accompanying drawings showing embodiments thereof.

Figure 1:
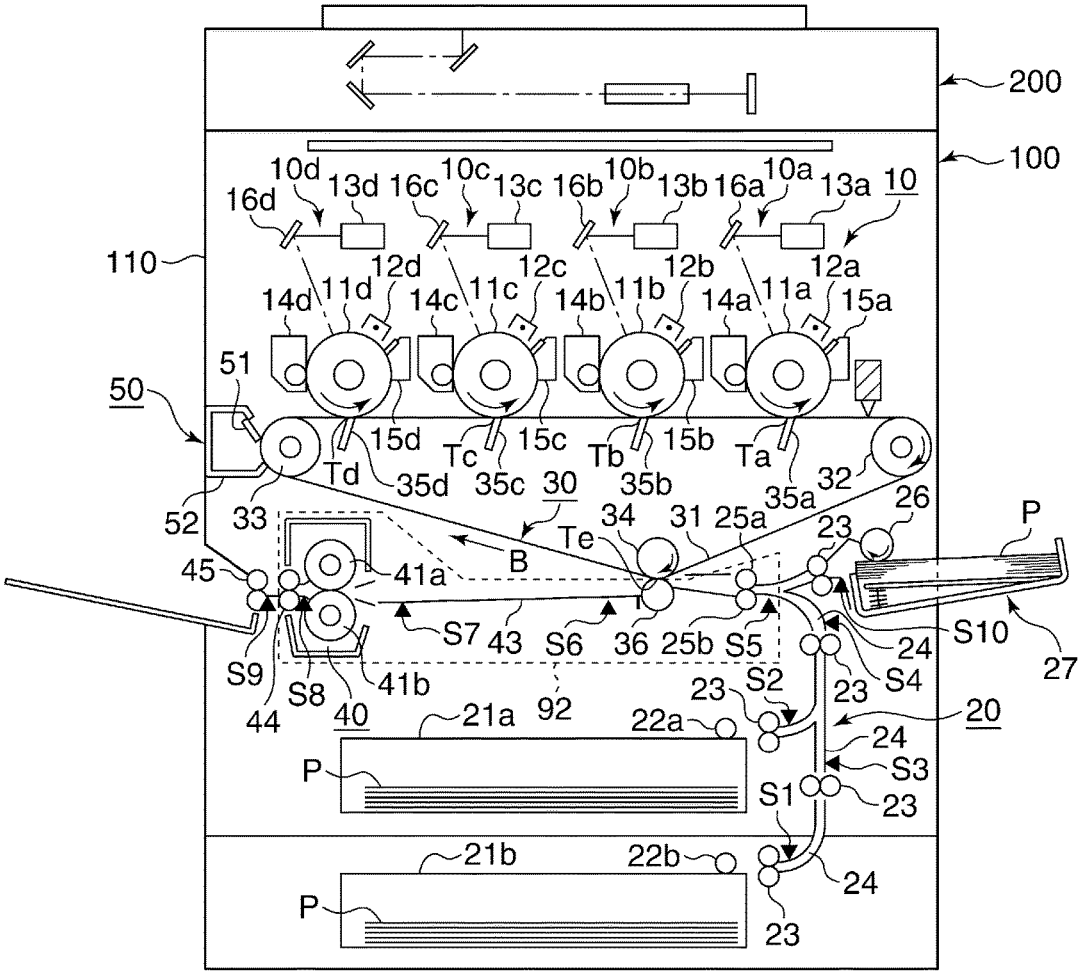
FIG. 1 is a schematic cross-sectional view of an image forming apparatus.

FIG. 1 is a schematic cross-sectional view of an image forming apparatus according to an embodiment of the present invention. This image forming apparatus is a color electrophotographic image forming apparatus that has a plurality of image forming sections 10 (10*a*, 10*b*, 10*c*, and 10*d*) arranged side by side, and employs an intermediate transfer system. This image forming apparatus includes an original reading section 200 that reads an original image and a printer section 100 that prints an image on a sheet as a transfer material. The printer section 100 includes not only the four image forming sections 10 arranged side by side, but also a sheet feed unit 20, an intermediate transfer unit 30, a fixing unit 40, and a controller 500 (see FIG. 4).

The image forming sections 10*a*, 10*b*, 10*c*, and 10*d* are stations for forming images of respective colors of black, cyan, magenta, and yellow. The image forming sections 10 each have the same configuration, and hence in the following description, when the corresponding component elements of the image forming sections 10 are not discriminated from each other, the same reference numerals are used, whereas when they are discriminated from each other, a, b, c, or d is added to each reference numeral.

In each image forming section 10, a photosensitive drum 11 (11*a*, 11*b*, 11*c*, 11*d*) as an electrophotographic photosensitive member having a cylindrical shape is rotatably supported, and is driven for rotation in an anticlockwise direction as viewed in FIG. 1. A primary charger 12 (12*a*, 12*b*, 12*c*, 12*d*) and an optical system 13 (13*a*, 13*b*, 13*c*, 13*d*) are arranged in a manner opposed to an outer peripheral surface of each photosensitive drum 11 in a direction of rotation of each photosensitive drum 11. Further, there are arranged a reflection mirror 16 (16*a*, 16*b*, 16*c*, 16*d*), a developing device 14 (14*a*, 14*b*, 14*c*, 14*d*), and a cleaner 15 (15*a*, 15*b*, 15*c*, 15*c*). The intermediate transfer unit 30 includes an intermediate transfer belt 31 as a belt-shaped intermediate transfer member. The intermediate transfer belt 31 is stretched and supported by a drive roller 32, a tension roller 33, and an opposed roller 34, and is driven by the drive roller 32 to rotate in a direction indicated by an arrow B at a predetermined process speed.

The primary chargers 12 charges the surfaces of the photosensitive drums 11 each with a uniform amount of electric charge. Laser beams emitted from the optical systems 13 expose the surfaces of the photosensitive drums 11 via the reflecting mirrors 16*a* to 16*d*, respectively, based on signals modulated according to image signals output from the original reading section 200, whereby electrostatic latent images are formed on the photosensitive drums 11. The electrostatic latent images are developed i.e. made visible by applying developing high voltage to the developing devices 14 storing developers (toners) of four colors, respectively, and developing sleeves provided in the respective developing devices 14. Further, the visible images developed on the photosensitive drums 11 are transferred onto the intermediate transfer belt 31 by primary transfer chargers 35 (35*a*, 35*b*, 35*c*, and 35*d*) to which high voltage is applied, at image transfer areas Ta, Tb, Tc, and Td, respectively. Toners remaining on the photosensitive drums 11, which are not transferred onto the intermediate transfer belt 31 at the image transfer areas Ta, Tb, Tc, and Td, are scraped off by the cleaners 15. With the above-described process, image formation is sequentially performed with each toner.

A cleaning device 50 is disposed at a location downstream of a second transfer area Te formed by the opposed roller 34 and a second transfer roller 36. The cleaning device 50 includes a cleaning blade 51 for removing toners on the intermediate transfer belt 31 and a collected toner box 52 for storing collected toners. The sheet feed unit 20 includes cassettes 21*a* and 21*b* for storing sheets P as the transfer material, and a manual feed tray 27. Pickup rollers 22*a*, 22*b*, and 26 feed the sheets P from the cassettes 21*a* and 21*b*, and the manual feed tray 27, one by one, respectively. When an image formation signal is delivered according to an input of a job, a sheet P fed by one of the pickup rollers 22*a*, 22*b*, and 26 is conveyed by a plurality of sheet feed roller pairs 23 and sheet feed guides 24. Registration rollers 25*a* and 25*b* feed the sheet P to the secondary transfer area Te in synchronism with the timing of image transfer to the sheet P at the secondary transfer area Te.

The fixing unit 40 includes a fixing roller 41*a* containing a heat source, such as a halogen heater, and a pressure roller 41*b* which is pressed by the fixing roller 41*a*. The pressure roller 41*b* may be also provided with a heat source. The image forming apparatus further includes a conveying guide 43 that guides the sheet P to a nip formed by a roller pair of the fixing roller 41*a* and the pressure roller 41*b*, and an inner discharge roller pair 44 and an outer discharge roller pair 45 that guide the sheet P discharged from the above-mentioned roller pair out of the apparatus.

When the sheet P is conveyed into the secondary transfer area Te, and is brought into contact with the intermediate transfer belt 31, high voltage is applied to the secondary transfer roller 36 in synchronism with the timing in which the sheet P passes the secondary transfer area Te. With this, the four-color toner image on the intermediate transfer belt 31 is transferred onto the surface of the sheet P. After that, the sheet P is guided to the nip between the fixing roller 41*a* and the pressure roller 41*b* by the conveying guide 43. Then, the toner image is fixed onto the surface of the sheet P by heat and pressure applied by the fixing roller 41*a* and the pressure roller 41*b*. Then, the sheet P is conveyed by the inner discharge roller pair 44 and the outer discharge roller pair 45, and is then discharged out of the apparatus.

A conveying path for conveying the sheet P through this image forming apparatus includes a conveying passage from the cassette 21*a*, 21*b*, or the manual feed tray 27 to the inner discharge roller pair 44 and the outer discharge roller pair 45, and is formed mainly by the sheet feed guides 24 and the conveying guide 43. The image forming apparatus includes a drawer unit 92 which is a removable unit that can be removably received into a main body 110 of the image forming apparatus. The drawer unit 92 is configured to be received in the main body 110 such that it can be drawn out therefrom and can be pushed therein, in a direction perpendicular to the sheet surface of FIG. 1. A conveying path portion within the main body 110 and a conveying path portion within the drawer unit 92 are communicated with each other to form the whole conveying path. The drawer unit 92 includes, as indicated by a broken line in FIG. 1, a range extending from slightly upstream of the registration rollers 25*a* and 25*b* to slightly upstream of the inner discharge roller pair 44 and the outer discharge roller pair 45. The drawer unit 92 contains the registration rollers 25*a* and 25*b*, the secondary transfer roller 36, and the fixing unit 40, but does not contain the opposed roller 34. Note that the sheet feed roller pairs 23, the sheet feed guides 24, the conveying guide 43, the registration rollers 25*a* and 25*b*, and the inner discharge roller pair 44 and the outer discharge roller pair 45 mainly function as a conveying unit configured to convey a sheet P on the conveying passage.

On the conveying passage, there are arranged sensors S1 to S10 as first to tenth sensors. The first sensor S1 and the second sensor S2 are sheet feed sensors, which are disposed at respective locations downstream of the sheet feed rollers 23 adjacent to the cassettes 21*b* and 21*a*, respectively. The third sensor S3 and the fourth sensor S4 are vertical path sensors, which are disposed on the sheet feed guides 24, respectively. Particularly, the fourth sensor S4 is at a location downstream of a point where a path along which a sheet P fed from the cassette 21*a* is conveyed and a path along which a sheet P fed from the cassette 21*b* is conveyed are joined. The fifth sensor S5 is a registration sensor disposed at a location upstream of the registration rollers 25*a* and 25*b*. The sixth sensor S6 is disposed at a location downstream of the secondary transfer roller 36. The seventh sensor S7 is disposed at a location upstream of the fixing unit 40 in the vicinity of an inlet of the fixing unit 40. The eighth sensor S8 is disposed at a location within the fixing unit 40 in the vicinity of an outlet of the fixing unit 40. The ninth sensor S9 is disposed between the fixing unit 40, and the inner discharge roller pair 44 and the outer discharge roller pair 45. The tenth sensor S10 is disposed between the manual feed tray 27 and the sheet feed roller pair 23.

The sensors S5 to S8 are located on the conveying path portion within the drawer unit 92. A boundary between the conveying path portion within the drawer unit 92 and the conveying path portion in the main body 110 extends between the fourth sensor S4 and the fifth sensor S5. Further, the boundary between the conveying path portion within the drawer unit 92 and the conveying path portion in the main body 110 extends between the eighth sensor S8 and the ninth sensor S9.

Figure 2A:
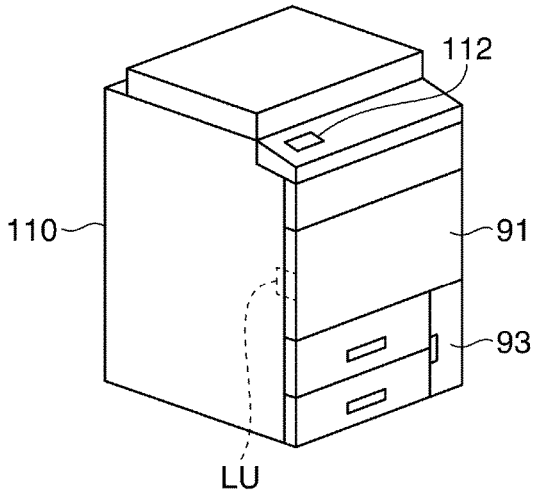
FIG. 2A is a perspective view of the image forming apparatus in a state in which a front door and a lower right door are closed.
Figure 2B:
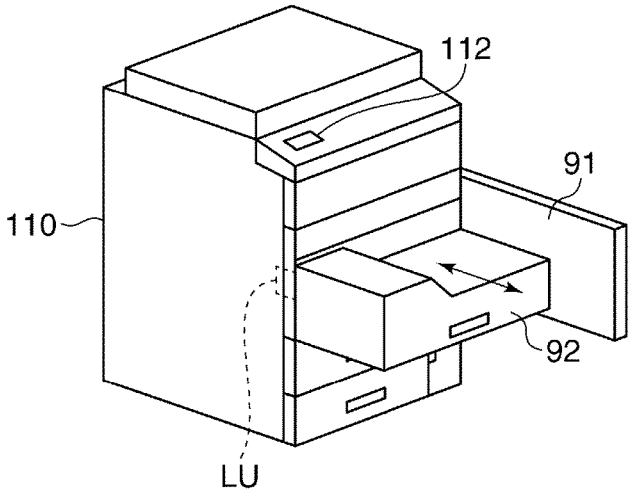
FIG. 2B is a perspective view of the image forming apparatus in a state in which the front door is opened and a drawer unit is drawn out.
Figure 2C:
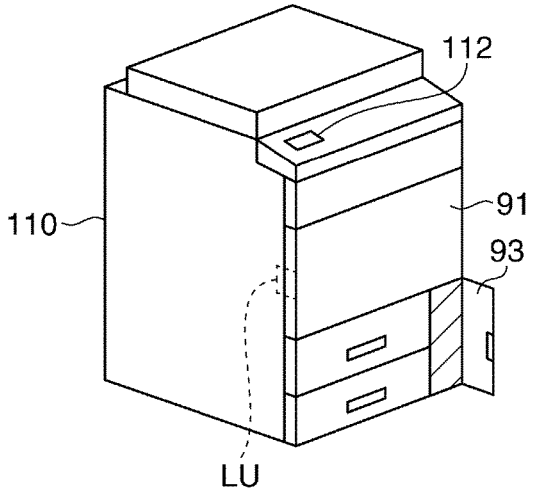
FIG. 2C is a perspective view of the image forming apparatus in a state in which the lower right door is opened.

FIGS. 2A, 2B, and 2C are perspective views of the image forming apparatus. A display section 112 is provided on an upper portion of the main body 110 of the image forming apparatus. The front side of the main body 110 is provided with a front door 91 and a lower right door 93, which are operated for rotation, respectively. When the front door 91 is opened, the user can access the inside of the image forming apparatus, and draw out the drawer unit 92 (see FIG. 2B). Although details are described hereinafter, in a case where a jam occurs in the drawer unit 92 during processing of a print job, the user can perform jam processing for removing a jammed sheet by opening the front door 91, and drawing out the drawer unit 92. In the main body 110, a lock unit LU as a lock portion is provided at a location corresponding to a free end of the front door 91 in a closed state thereof. The lock unit LU is switched between a locking state in which the drawer unit 92 is inhibited from being drawn out and an unlocking state in which the drawer unit 92 can be drawn out. That is, in the locking state of the lock unit LU, the front door 91 is locked, and hence the user cannot perform an operation for opening the front door 91, and therefore, the user also cannot draw out the drawer unit 92. On the other hand, in a case where a jam occurs in the sheet feed guides 24, the user can open the lower right door 93, and remove a jammed sheet (see FIG. 2C).

Figure 3A:
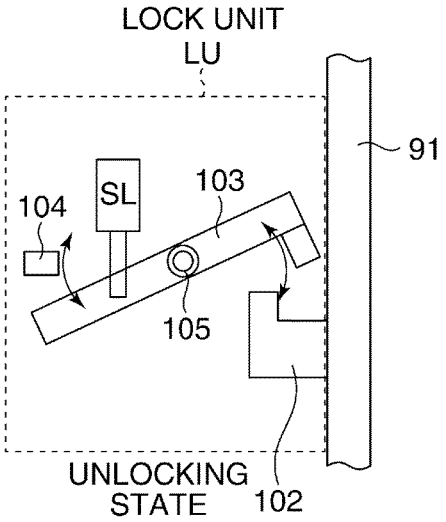
FIG. 3A is a schematic side view of a lock unit in an unlocking state.
Figure 3B:
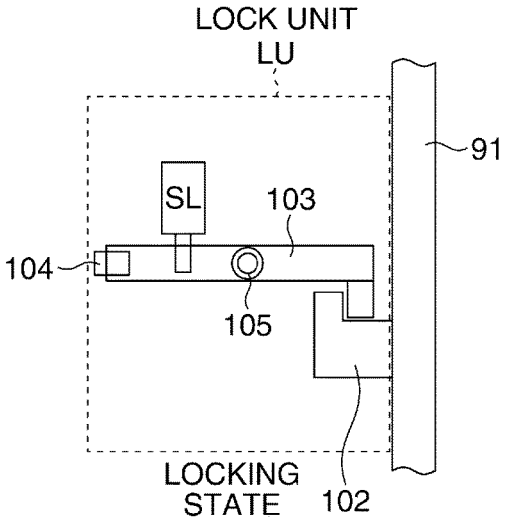
FIG. 3B is a schematic side view of the lock unit in a locking state.

FIGS. 3A and 3B are schematic side views of the lock unit LU in the unlocking state and the locking state, respectively. The front door 91 has a hook-shaped engaging member 102 provided on a portion (free end portion) thereof opposite from the center of rotation in a longitudinal direction so as to make it possible to lock the front door 91 in the closed state. In the lock unit LU, there is provided a latch member 103 which is rotatable about a rotational shaft 105, in a manner opposed to the engaging member 102. In the lock unit LU, there is provided a lock sensor 104 as a lock detector for detecting the state of the lock unit LU. The latch member 103 is driven for rotation by a solenoid SL. When a front end portion of the latch member 103 is in a position engaged with the engaging member 102, the lock unit LU is in the locking state (see FIG. 3B). When the front end portion of the latch member 103 is in a position away from the engaging member 102, and unengaged with the engaging member 102, the lock unit LU is in the unlocking state (see FIG. 3A). The lock sensor 104 detects whether the lock unit LU is in the locking state or the unlocking state. When the lock unit LU is in the unlocking state, the user can open the front door 91, but when the lock unit LU is in the locking state, the user cannot open the front door 91.

Figure 4:
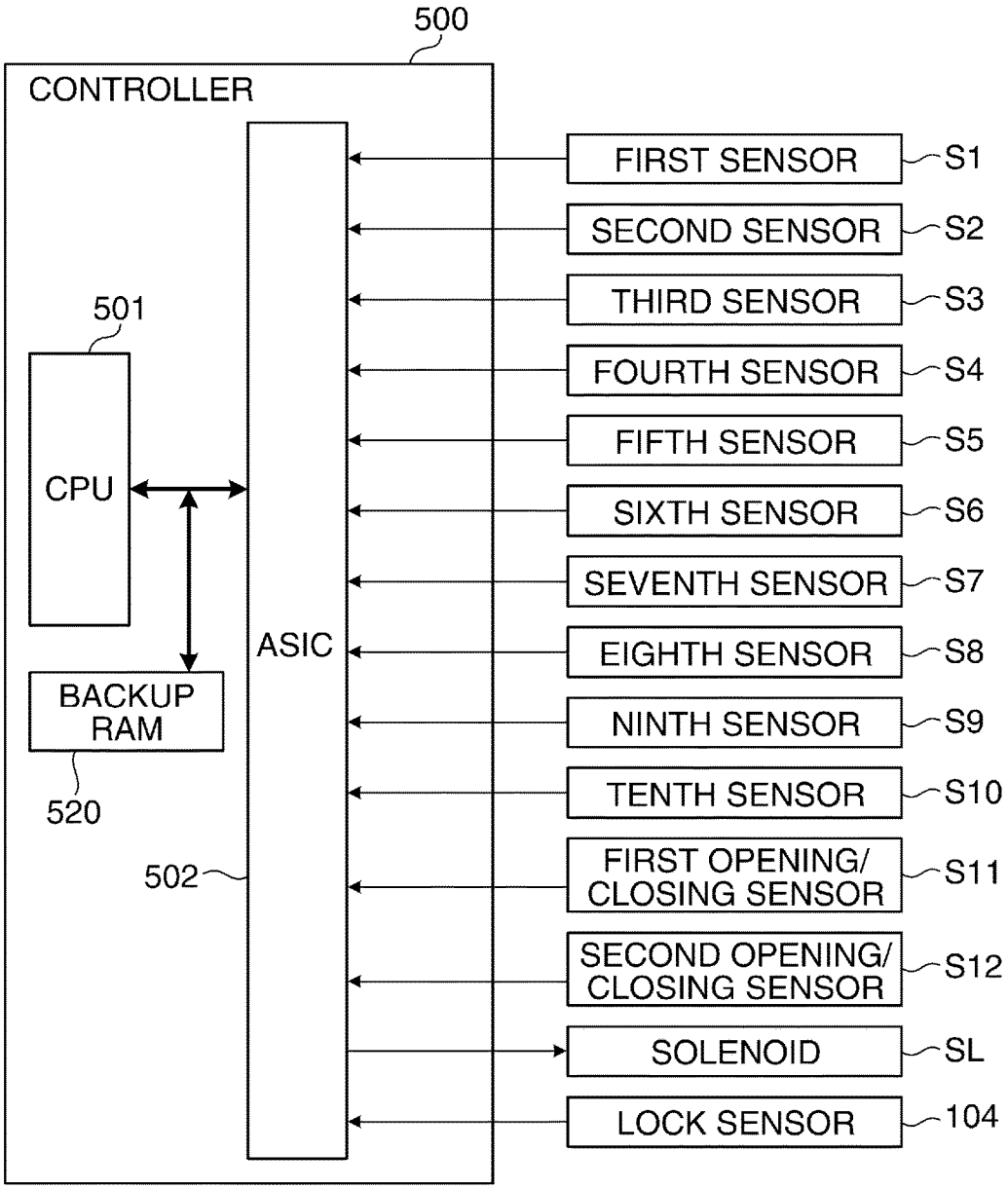
FIG. 4 is a block diagram of a control mechanism of the image forming apparatus.

FIG. 4 is a block diagram of a control mechanism of the image forming apparatus. The controller 500 includes a CPU 501, an ASIC 502, and a backup RAM 520. The CPU 501 transmits and receives a signal to and from the ASIC 502 after establishing communication therewith. The CPU 501 is a central processing unit that executes various commands so as to control various motors and various sensors of the whole apparatus. The CPU 501 incorporates a storage memory (not shown), such as a ROM and a RAM, and executes various commands based on programs stored in the ROM in advance. The backup RAM 520 is a storage memory having a battery, which is capable of holding data even in a state in which the power supply of the image forming apparatus is stopped. Not only the above-mentioned first to tenth sensors S1 to S10, and the lock sensor 104, but also a first opening/closing sensor S11 and a second opening/closing sensor S12 are provided. The first opening/closing sensor S11 detects the opened/closed state of the front door 91. The second opening/closing sensor S12 detects the opened/closed state of the lower right door 93.

The ASIC 502 is a highly integrated circuit, and has a function of generating control signals output to motor drive sections that drives the various motors, respectively, and a function of taking in output signals from the various sensors, and performing high-speed processing thereof. The CPU 501 controls sheet conveyance according to the control signals output from the ASIC 502 to the motor drive sections and the output signals taken into the ASIC 502 from the various sensors. The CPU 501 further outputs a signal indicative of a locking instruction or an unlocking instruction to the solenoid SL of the lock unit LU via the ASIC 502.

Figure 6:
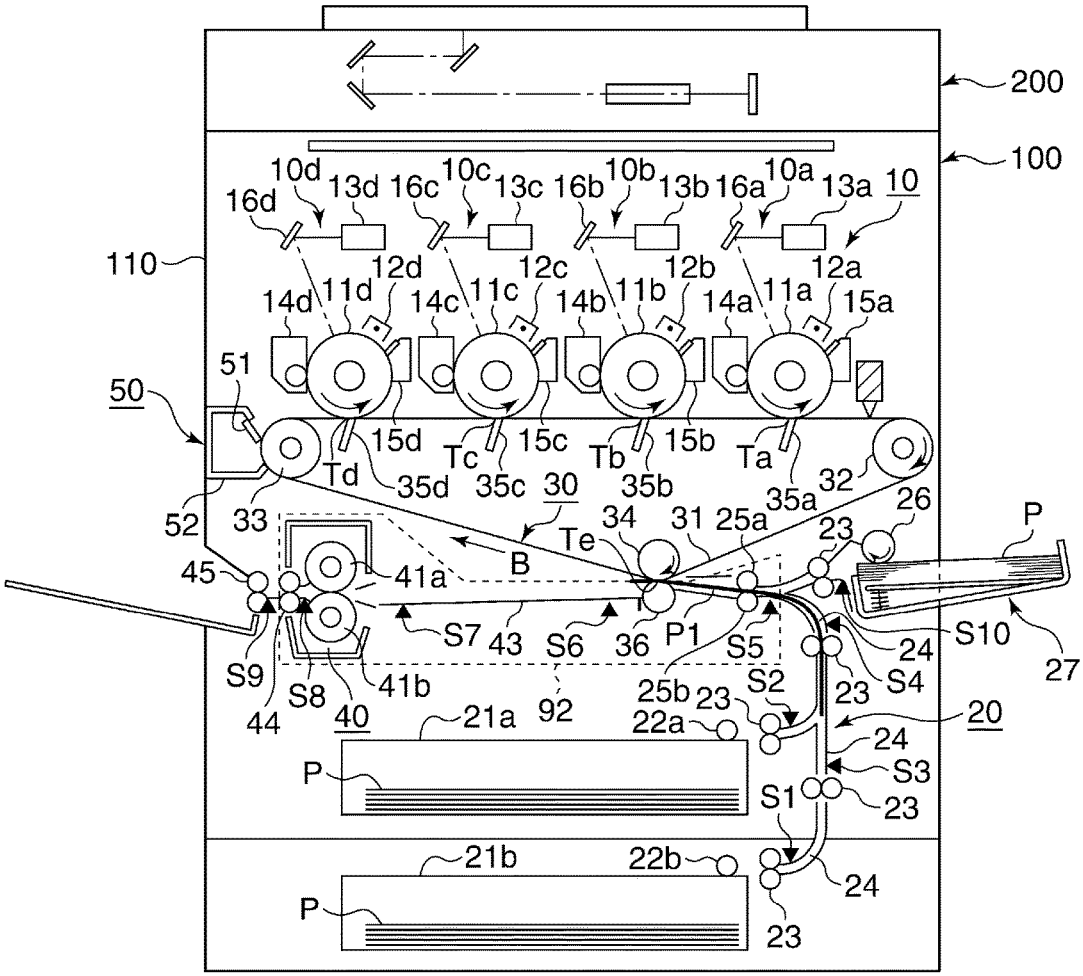
FIG. 6 is a schematic cross-sectional view of the image forming apparatus in a state in which a boundary-crossing jam has occurred at an end portion upstream of the drawer unit.
Figure 7:
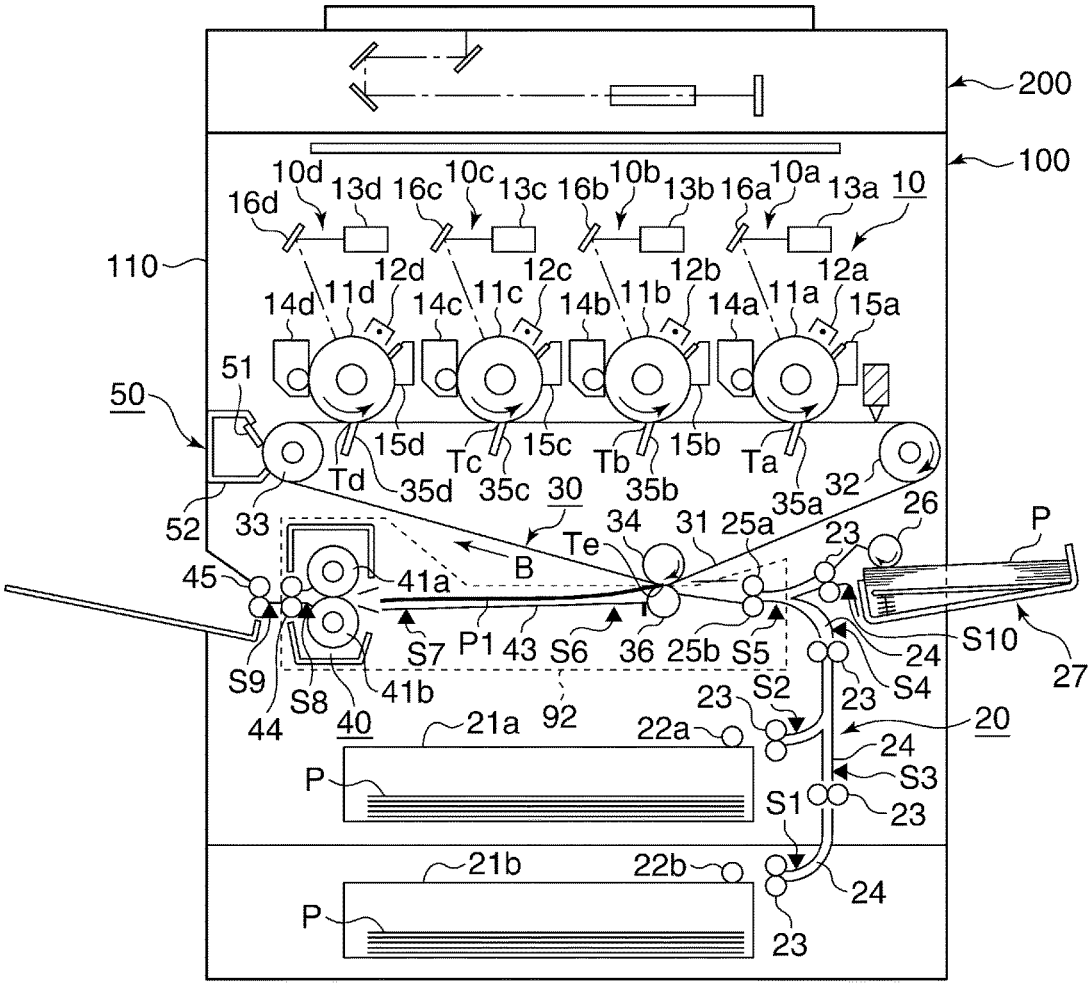
FIG. 7 is a schematic cross-sectional view of the image forming apparatus in a state in which a jam has occurred within the drawer unit.
Figure 8:
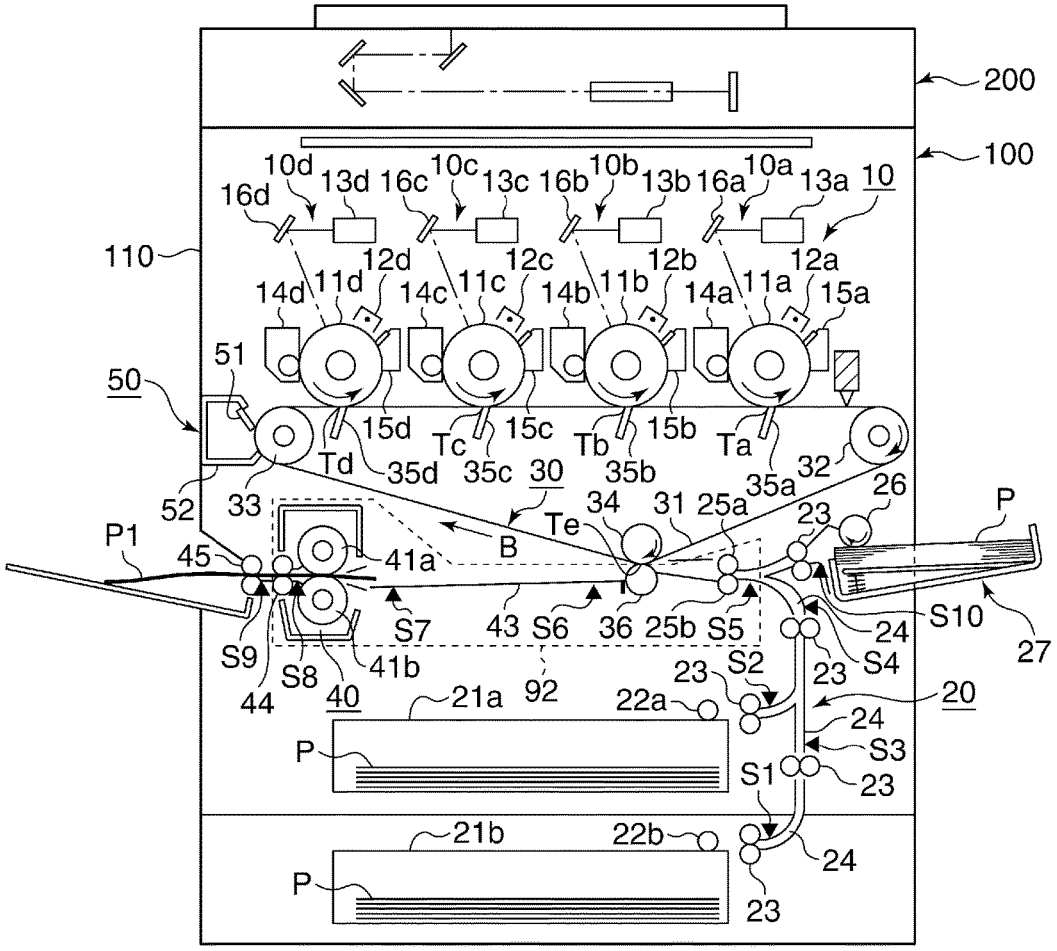
FIG. 8 is a schematic cross-sectional view of the image forming apparatus in a state in which a boundary-crossing jam has occurred at an end portion downstream of the drawer unit.

Next, situations of sheet jam and the lock condition will be described with reference to FIGS. 5 to 8. FIG. 5 is a diagram showing a lock condition table. FIGS. 6 to 8 are schematic cross-sectional views of the image forming apparatus in the respective situations of sheet jam. Note that the first to tenth sensors S1 to S10 each function as a jam detector for detecting a position of a sheet P jammed in the conveying passage. For example, if none of the sensors S1 to S10 detect the passing of a sheet P for a predetermined time period, the CPU 501 detects that a jam has occurred. A position of occurrence of the jam is determined by a sensor S that is outputting a signal indicative of sheet detection. Note that the sensors S1 to S10 are only required to be capable of detect a position of occurrence of a jam, and hence any configuration can be employed as the sensors S1 to S10.

A sheet P can be jammed at any point in the conveying path during job processing. For example, as shown in FIG. 6, a jam can occur in which a sheet P stops at a position where it crosses a boundary between the conveying path portion within the drawer unit 92 and a conveying path portion upstream of the drawer unit 92. If such a jam is detected, the fourth sensor S4 and the fifth sensor S5 both output a signal indicative of sheet detection. Further, as shown in FIG. 8, a jam can occur in which a sheet P stops at a position where it crosses a boundary between the conveying path portion within the drawer unit 92 and a conveying path portion downstream of the drawer unit 92. If such a jam is detected, the eighth sensor S8 and the ninth sensor S9 both output a signal indicative of sheet detection.

On the other hand, as shown in FIG. 7, a jam can occur in which a sheet P stops in a "predetermined range", i.e. the sheet P stops within the drawer unit 92 without crossing the boundary between the conveying path portion in the main body 110 and the conveying portion within the drawer unit 92. If such a jam is detected, at least one of the sensors S5 to S8 outputs a signal indicative of sheet detection, but the sensors S other than S5 to S8 (at least the sensors S4 and S9) do not output a signal indicative of sheet detection. When a jam occurs in the predetermined range, it is impossible to perform jam processing without opening the front door 91.

Hereinafter the jams in the states shown in FIGS. 6 and 8 are sometimes referred to as the "boundary-crossing jam" in an abbreviated form. When the lock unit LU is locked, this state is sometimes expressed as "the front door 91 is locked". When removing such a boundary-crossing jam as shown in FIG. 6, and a jam occurring at a position upstream of the drawer unit 92, it is possible to perform jam processing by opening the lower right door 93, and hence it is unnecessary to draw out the drawer unit 92. Further, when removing such a boundary-crossing jam as shown in FIG. 8, it is possible to perform jam processing from the discharge outlet side, and hence it is unnecessary to draw out the drawer unit 92.

In a case where a boundary-crossing jam occurs, unless the front door 91 is locked, the user draws out the drawer unit 92, which may cause a situation in which the jammed sheet P is broken when the user draws out the drawer unit 92, and make it difficult to remove the sheet P. For this reason, it is appropriate to lock the front door 91 when a boundary-crossing jam occurs. As shown in FIG. 8, when a jam occurs, if the sensors S4 and S5 both output a signal indicative of sheet detection, or if the sensors S8 and S9 both output a signal indicative of sheet detection, a lock condition for locking the lock unit LU is satisfied. When the lock condition is satisfied, the CPU 501 sends a locking instruction to the lock unit LU via the ASIC 502. After that, when jam processing is properly completed to cause at least one of the sensors S4 and S5 or at least one of the sensors S8 and S9 to be turned off (stops outputting of a signal indicative of sheet detection), the lock condition is no longer satisfied, so that the CPU 501 sends an unlocking instruction to the lock unit LU via the ASIC 502. The solenoid SL drives the latch member 103 in an unlocking direction according to the unlocking instruction. Note that it is to be understood that when the CPU 501 sends a locking instruction, the solenoid SL drives the latch member 103 in an locking direction according to the locking instruction.

Figure 9:
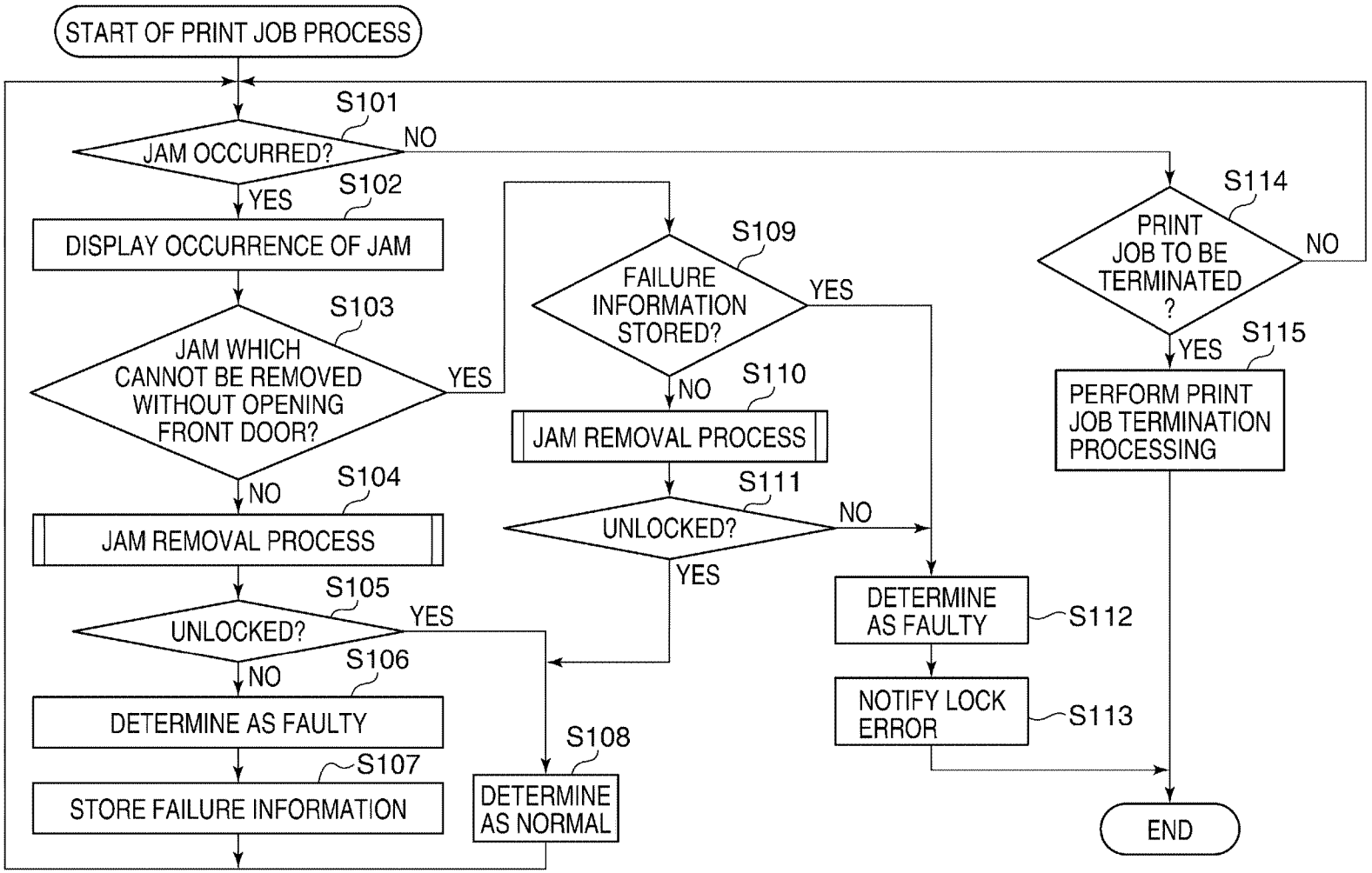
FIG. 9 is a flowchart of a print job process.

FIG. 9 is a flowchart of a print job process. The print job process in FIG. 9 is realized by the CPU 501 that reads and executes a program stored in the storage section, such as the ROM included in the CPU 501. This process is started when a job is input. The CPU 501 functions as a controller of the present invention.

When a sheet P is conveyed along the conveying path so as to perform processing of the print job, first, the CPU 501 determines whether or not a jam has occurred in the conveying passage based on outputs from the sensors S1 to S10 (step S101). If it is determined in the step S101 that a jam has not occurred, the CPU 501 proceeds to a step S114, and determines whether or not the print job is to be terminated. Then, if the print job is not to be terminated, the CPU 501 returns to the step S101, whereas if the print job is to be terminated, the CPU 501 performs print job termination processing (step S115), followed by terminating the present process. If it is determined in the step S101 that a jam has occurred, the CPU 501 temporarily interrupts the print job (also stops sheet conveyance), and displays information to the effect that a jam has occurred on the display section 112 (see FIGS. 2A to 2C) (step S102).

Next, in a step S103, the CPU 501 determines whether or not it is possible to perform jam processing without opening the front door 91. More specifically, the CPU 501 determines whether or not a position where the jam has occurred is a position in the predetermined range in which it is necessary to draw the drawer unit 92 so as to perform jam processing. As described above, in a case where none of the sensors S1 to S4 out of the sensors S1 to S10 output a signal indicative of sheet detection, and only any of the sensors S5 to S8 outputs a signal indicative of sheet detection, it is determined that a jam has occurred in the predetermined range and it is impossible to perform jam processing without opening the front door 91. If it is determined in the step S103 that it is possible to perform jam processing without opening the front door 91, this is a case where a boundary-crossing jam has occurred or a jam has occurred outside the drawer unit 92, and hence the CPU 501 proceeds to a step S104. On the other hand, if it is determined that it is impossible to perform jam processing without opening the front door 91, this is a case where a jam has occurred in which the sheet P stops within the drawer unit 92 without crossing the boundary between the conveying path portion in the main body 110 and the conveying path portion within the drawer unit 92. Therefore, the CPU 501 proceeds to a step S109. In the step S104, the CPU 501 performs a jam removal process (see FIG. 10) as a subroutine.

Figure 10:
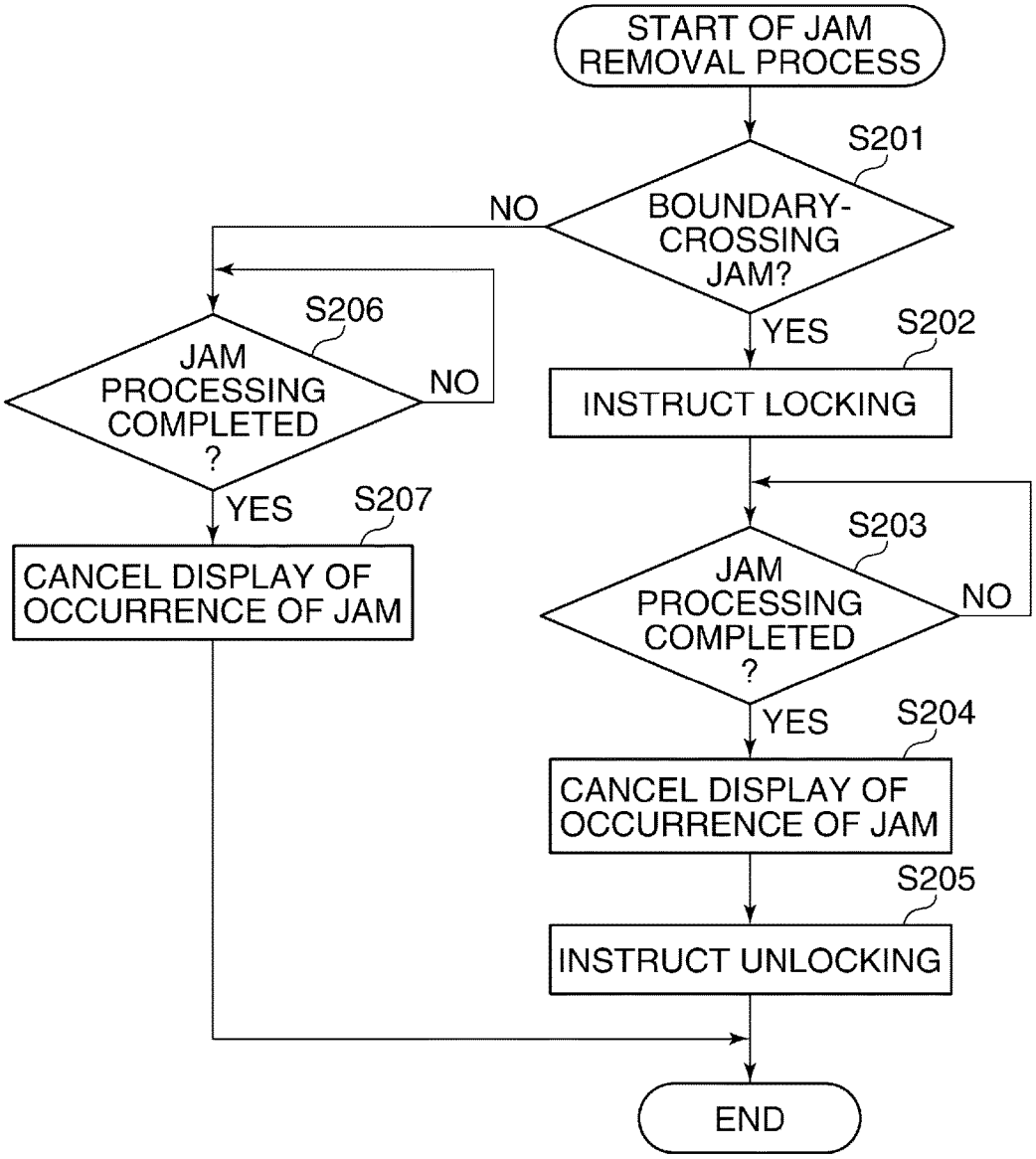
FIG. 10 is a flowchart of a jam removal process.

FIG. 10 is a flowchart of the jam removal process performed in the steps S104 and S110. First, in a step S201, the CPU 501 determines whether or not a boundary-crossing jam has occurred. If it is determined in the step S201 that a boundary-crossing jam has not occurred, the CPU 501 waits until jam processing is completed (step S206). In the step S206, when the sensor S which has been outputting a signal indicative of sheet detection stops outputting of the signal indicative of sheet detection, it is determined that jam processing is completed. When jam processing is completed, the CPU 501 cancels the display of occurrence of the jam on the display section 112 (step S207), followed by terminating the jam removal process in FIG. 10.

If it is determined in the step S201 that a boundary-crossing jam has occurred, the lock condition is satisfied, and hence the CPU 501 sends a locking instruction to the lock unit LU (step S202). With this instruction, the front door 91 is prevented from being opened, and the drawer unit 92 is prevented from being carelessly drawn out. Then, the CPU 501 waits until jam processing is completed (step S203). In the step S203, when the sensor S which has been outputting a signal indicative of sheet detection stops outputting of the signal indicative of sheet detection, it is determined that jam processing is completed, and the lock condition is no longer satisfied. Then, the CPU 501 cancels the display of occurrence of the jam on the display section 112 (step S204), and sends an unlocking instruction to the lock unit LU (step S205). With this, when the lock unit LU normally operates, it is possible to open the front door 91. After that, the jam removal process in FIG. 10 is terminated.

Referring again to FIG. 9, after execution of the step S104, the CPU 501 determines whether or not the lock unit LU is unlocked (step S105). In this step, the determination of whether or not the lock unit LU is unlocked is not the determination of whether or not the unlocking instruction is provided, but the determination of whether or not the lock unit LU is actually in the unlocking state, and this determination is performed based on a result of detection by the lock sensor 104. Note that the lock unit LU is in the unlocking state when the print job is started, and is also in the unlocking state when the print job is being normally processed (before a jam occurs) and after the print job is normally terminated. If it is determined in the step S105 that the lock unit LU is unlocked, this indicates that the lock unit LU normally functions, and hence the CPU 501 judges that the lock unit LU is normally operated (step S108), and the process returns to the step S101. As a result, the process proceeds from the step S101 to the step S114, and the CPU 501 controls the interrupted job to be resumed.

On the other hand, if it is determined in the step S105 that the lock unit LU is not unlocked, it can be judged that the lock unit LU is faulty, and hence the CPU 501 determines that the lock unit LU is faulty (step S106). Then, the CPU 501 stores failure information indicating that the lock unit LU is faulty in the backup RAM 520 (step S107). In this step, the CPU 501 stores the failure information, but does not treat this failure as an error, and returns to the step S101. Therefore, although the lock unit LU still remains faulty, the process proceeds from the step S101 to the step S114, and the CPU 501 controls the interrupted job to be resumed. Even if the lock unit LU is faulty, the image forming operation can be performed unless it is required to draw out the drawer unit 92, and hence an unnecessary downtime is prevented from being generated. As described above, in a case where a jam occurs which cannot be removed without opening the front door 91, even when the unlocking state of the lock unit LU is not detected after jam processing, a job which has been interrupted due to the jam is not forcibly terminated, but resumed after completion of jam processing.

Note that when the failure information is stored, information to the effect that the lock unit LU is faulty is displayed in a special mode on the display section 112 or another display section. Even when the main body 110 is not in an error state, a service person who has acquired this failure information can perform a maintenance operation e.g. for replacing the lock unit LU.

In the step S109, the CPU 501 determines whether or not the failure information has been stored in the backup RAM 520. If it is determined in the step S109 that the failure information has not been stored in the backup RAM 520, the CPU 501 performs the jam removal process (see FIG. 10) in a step S110. After that, the CPU 501 determines whether or not the lock unit LU is unlocked similarly to the step S105 (step S111). If it is determined in the step S111 that the lock unit LU is unlocked, this indicates that the lock unit LU normally functions, and hence the CPU 501 proceeds to the step S108. On the other hand, if the lock unit LU is not unlocked, it can be judged that the lock unit LU is faulty, and hence the CPU 501 proceeds to a step S112.

On the other hand, if it is determined in the step S109 that the failure information has been stored in the backup RAM 520, the CPU 501 proceeds to the step S112. In the step S112, the CPU 501 determines that the lock unit LU is faulty. In a case where the process proceeds from the step S109 to the step S112, the CPU 501 can determine that the lock unit LU is faulty without performing the jam removal process (see FIG. 10), and also without referring to a result of the detection by the lock sensor 104. Therefore, the processing is quickly performed. After that, in a step S113, the CPU 501 notifies the user of a lock error by displaying information to the effect that the lock unit LU is faulty, on the display section 112, followed by terminating the present process. Accordingly, the interrupted job is forcibly terminated.

Here, a description will be given of an example of a situation which causes a lock error. Let it be assumed that two print jobs: a print job 1 which is executed first, and a print job 2 executed after the print job 1, are sequentially executed. First, if a boundary-crossing jam occurs during processing of the print job 1, the process proceeds in the order of the steps S101, S102, S103, and S104 in FIG. 9. In the step S104, the steps S201 to S205 are executed. Since the unlocking instruction is provided to the lock unit LU in the step S205, if the lock unit LU normally functions, the lock unit LU is unlocked. However, if the lock unit LU does not normally function, it is determined in the step S105 that the lock unit LU is not unlocked, whereby it is determined that the lock unit LU is faulty, and the failure information is stored (S105→S106→S107). In this case, the job is resumed without being forcibly terminated, and thereafter, unless an abnormality occurs, such as occurrence of a new jam, when the job is terminated after repeatedly executing the steps S101 and S114, the print job process in FIG. 9 is terminated.

Next, it is assumed that processing of the print job 2 is started, and a jam occurs at a position where it is necessary to draw out the drawer unit 92. In this case, jam processing cannot be performed without opening the front door 91, and hence the process proceeds in the order of the steps S101, S102, S103, and S109. Since the failure information has been stored in the print job 1, the process proceeds in the order of the steps S109, S112 and S113.

According to the present embodiment, in a case where a jam which can be removed without drawing out the drawer unit 92 has occurred, even if the unlocking state of the lock unit LU is not detected, a job which is interrupted due to occurrence of the jam is not forcibly terminated, but is resumed after completion of the jam processing. This makes it possible to prevent the job from being forcibly terminated in a situation where it is unnecessary to draw out the drawer unit 92, and reduce downtime.

Further, failure information is stored in a case where the unlocking state of the lock unit LU is not detected, and if a jam which is not a boundary-crossing jam occurs within the drawer unit 92 after that, failure determination is immediately performed based on the failure information, so that a lock error is notified. This makes it possible to forcibly terminate the job without waiting for completion of jam processing, so that the processing is simplified and is quickly executed.

Although to lock the drawer unit 92 so as to inhibit the user from drawing out the drawer unit 92, the present embodiment is configured such that the operation for opening the front door 91 is inhibited, this is not limitative. That is, to prevent a user from drawing out the drawer unit 92, it is only required to lock the drawer unit 92, and hence a mechanism for locking the operation of drawing out the drawer unit 92 itself may be provided in association with the drawer unit 92. Note that the drawer unit 92 is described as a removable unit which is removably received into the main body 110, by way of example. However, the removal unit is not necessarily required to have a form of the drawer, but is only required to be configured such that it can be mounted to and removed from the main body 110, and the conveying path portion in the main body 110 and the conveying path portion in the removable unit are connected when the removable unit is mounted to the main body 110.

Note that if a jam which is not a boundary-crossing jam occurs within the drawer unit 92, and the lock unit LU becomes faulty immediately after the process proceeds to the step S206 in FIG. 10, a user cannot open the front door 91 and cannot perform jam processing. Therefore, for example, in a case where jam processing is not completed even after a predetermined time period elapses, the determination of whether or not the lock unit LU is unlocked may be performed. Then, if the lock unit LU is not unlocked, failure determination of the lock unit LU and a lock error notification may be performed, and the job may be forcibly terminated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-129079 filed Jun. 29, 2016, which is hereby incorporated by reference herein in its entirety.

What is claimed is:

1. An image forming apparatus comprising:

a conveying unit configured to convey a sheet along a conveying path so as to process a job;

a drawer unit configured to be drawn out from the image forming apparatus;

a lock portion configured to be switched between a locking state for inhibiting the drawer unit from being drawn out and an unlocking state for permitting the drawer unit to be drawn out;

a jam detector configured to detect a position in the conveying path where a jam of the sheet has occurred;

a lock detector configured to detect a state of the lock portion; and a controller configured to:

determine, based on the detected state of the lock detector, whether a failure of the lock portion being not unlocked has occurred; and resume, in a case where the jam detector detects an occurrence of a jam at a position outside a predetermined range in which it is necessary to draw out the drawer unit in order to perform jam processing, the job which has been interrupted due to the jam after completion of the jam processing, without forcibly terminating the job before finished, even if it is determined that the failure of the lock portion being not unlocked has occurred.

2. The image forming apparatus according to claim 1, further comprising a memory configured to store failure information to the effect the failure has occurred, wherein the controller is configured to store the failure information in the memory, in a case where the lock detector does not detect the unlocking state even if the controller provides an instruction for unlocking the lock portion.

3. The image forming apparatus according to claim 2, wherein in a case where an occurrence of a jam at a position within the predetermined range is detected, when the failure information has been stored in the memory, the controller is configured to forcibly terminate the job without waiting for execution of jam processing.

4. The image forming apparatus according to claim 2, wherein in a case where an occurrence of a jam at a position within the predetermined range is detected, when the failure information has not been stored in the memory, the controller is configured to forcibly terminate the job unless the unlocking state of the lock portion is detected after completion of the jam processing.

5. The image forming apparatus according to claim 2, wherein in a case where an occurrence of a jam at a position within the predetermined range is detected, when the failure information has not been stored in the memory, the controller is configured to resume the job on condition that the unlocking state of the lock portion is detected after completion of the jam processing.

6. The image forming apparatus according to claim 4, wherein when the controller forcibly terminates the job, the controller is configured to make a notification that the lock portion is faulty.

7. The image forming apparatus according to claim 2, wherein the lock detector is configured to detect a state of the lock portion after completion of the jam processing.

8. The image forming apparatus according to claim 1, wherein in a case where an occurrence of a jam of the sheet is detected at a position where the sheet crosses a boundary between a conveying path portion within the drawer unit and a conveying path portion outside the drawer unit, the controller is configured to provide an instruction for locking the lock portion to the lock portion, and when the jam processing is completed thereafter, the controller is configured to provide an instruction for unlocking the lock portion to the lock portion.

9. An image forming apparatus comprising:

a conveying unit configured to convey a sheet along a conveying path so as to process a job;

a drawer unit configured to be drawn out from the image forming apparatus;

a lock portion configured to be switched between a locking state for inhibiting the drawer unit from being drawn out and an unlocking state for permitting the drawer unit to be drawn out;

a jam detector configured to detect a position in the conveying path where a jam of the sheet has occurred:

a lock detector configured to detect a state of the lock portion;

a memory configured to store, in a case where an occurrence of a jam at a position outside the predetermined range is detected, and also the unlocking state of the lock portion is not detected, information to the effect that the lock portion is faulty; and a controller configured to resume, in a case where the jam detector detects the occurrence of the jam at the position outside the predetermined range in which it is necessary to draw out the drawer unit in order to perform jam processing, the job which has been interrupted due to the jam after completion of the jam processing, without forcibly terminating the job before finished, even if the lock detector has not detected the unlocking state of the lock portion, wherein in a case where occurrence of a jam at a position within the predetermined range is detected, when the information to the effect that the lock portion is faulty has been stored in the memory, the controller is configured to forcibly terminate the job without waiting for execution of jam processing.

10. An image forming apparatus comprising:

a conveying unit configured to convey a sheet along a conveying path so as to process a job;

a drawer unit configured to be drawn out from the image forming apparatus;

a lock portion configured to be switched between a locking state for inhibiting the drawer unit from being drawn out and an unlocking state for permitting the drawer unit to be drawn out;

a jam detector configured to detect a position in the conveying path where a jam of the sheet has occurred;

a lock detector configured to detect a state of the lock portion; and a controller configured to resume, in a case where the jam detector detects an occurrence of a jam at a position outside the predetermined range in which it is necessary to draw out the drawer unit in order to perform jam processing, the job which has been interrupted due to the jam after completion of the jam processing, without forcibly terminating the job before finished, even if the lock detector has not detected the unlocking state of the lock portion, wherein the predetermined range is a range in which the sheet stops within the drawer unit without crossing a boundary between a conveying path portion within the drawer unit and a conveying path portion outside the drawer unit.

11. An image forming apparatus comprising:

a conveying unit configured to convey a sheet along a conveying path so as to process a job;

a drawer unit configured to be drawn out from the image forming apparatus;

a lock portion configured to be switched between a locking state for inhibiting the drawer unit from being drawn out and an unlocking state for permitting the drawer unit to be drawn out;

a jam detector configured to detect a position in the conveying path where a jam of the sheet has occurred;

a lock detector configured to detect a state of the lock portion;

a notifying unit configured to notify an information;

a memory configured to store a failure information indicating an occurrence of a failure of the lock portion in which the lock portion cannot be switched to the unlocking state; and a controller configured to:

in a case where the jam detector detects an occurrence of a jam at a position within a predetermined range in which it is necessary to draw out the drawer unit in order to perform jam processing and the memory stores the failure information, control the notifying unit to notify the occurrence of the failure of the lock portion, and in a case where the jam detector detects an occurrence of a jam at a position outside a predetermined range in which it is necessary to draw out the drawer unit in order to perform jam processing and the memory stores the failure information, control the notifying unit to not notify the occurrence of the failure of the lock portion.

* * * * *